US009469967B2

(12) United States Patent
Edara et al.

(10) Patent No.: US 9,469,967 B2
(45) Date of Patent: Oct. 18, 2016

(54) SYSTEM AND METHOD FOR CONTROLLING THE OPERATION OF A MACHINE

(71) Applicant: Caterpillar Inc., Peoria, IL (US)

(72) Inventors: Thandava K. Edara, Peoria, IL (US); Michael Taylor, Swissvale, PA (US); Troy K. Becicka, Sahuarita, AZ (US); Jean-Jacques Clar, Edelstein, IL (US); Kyle Edwards, Gillette, WY (US); Mo Wei, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 58 days.

(21) Appl. No.: 14/484,710

(22) Filed: Sep. 12, 2014

(65) Prior Publication Data

US 2016/0076224 A1 Mar. 17, 2016

(51) Int. Cl.
*E02F 9/20* (2006.01)

(52) U.S. Cl.
CPC ..... *E02F 9/2029* (2013.01); *E02F 9/2041* (2013.01)

(58) Field of Classification Search
CPC ..... E02F 9/2029; E02F 9/2041
USPC ..... 701/50, 410
See application file for complete search history.

(56) References Cited

U.S. PATENT DOCUMENTS

| | | | | |
|---|---|---|---|---|
| 4,926,948 | A | 5/1990 | Davidson et al. | |
| 5,462,122 | A | 10/1995 | Yamamoto et al. | |
| 5,551,524 | A | 9/1996 | Yamamoto et al. | |
| 5,864,970 | A * | 2/1999 | Maddock | E02F 3/188 37/908 |
| 5,875,854 | A | 3/1999 | Yamamoto et al. | |
| 5,984,018 | A | 11/1999 | Yamamoto et al. | |
| 6,076,030 | A | 6/2000 | Rowe | |
| 6,167,336 | A | 12/2000 | Singh et al. | |
| 6,181,999 | B1 | 1/2001 | Yamamoto et al. | |
| 6,223,110 | B1 | 4/2001 | Rowe et al. | |
| 6,421,627 | B1 | 7/2002 | Ericsson | |
| 6,445,310 | B1 | 9/2002 | Bateman et al. | |
| 6,655,465 | B2 | 12/2003 | Carlson et al. | |
| 6,845,311 | B1 | 1/2005 | Stratton et al. | |
| 7,216,033 | B2 | 5/2007 | Flann et al. | |
| 7,578,079 | B2 | 8/2009 | Furem | |
| 7,676,967 | B2 | 3/2010 | Gharsalli et al. | |
| 7,734,398 | B2 | 6/2010 | Manneppalli | |

(Continued)

FOREIGN PATENT DOCUMENTS

WO WO 2008/118027 10/2008

OTHER PUBLICATIONS

U.S. Appl. No. 14/484,694, filed Sep. 12, 2014.

(Continued)

*Primary Examiner* — Fadey Jabr
*Assistant Examiner* — Yazan Soofi
(74) *Attorney, Agent, or Firm* — Leydig, Voit & Mayer, Ltd.; L. Glenn Waterfield

(57) ABSTRACT

A system for automated control of a machine includes a position sensor and a controller. The controller is configured to determine a position of a work surface along a first slot and along a second slot. The work surface along the first slot and the second slot define at least a portion of a berm. The controller is further configured to determine a physical characteristic of the first slot and the second slot and generate a berm reduction command if the physical characteristic of the first slot and the second slot is less than the characteristic threshold of the first slot and the second slot.

20 Claims, 7 Drawing Sheets

(56) References Cited

U.S. PATENT DOCUMENTS

| | | | | |
|---|---|---|---|---|
| 7,979,175 | B2 | 7/2011 | Allard et al. | |
| 8,031,629 | B2 | 10/2011 | Stegmaier et al. | |
| 8,073,584 | B2 | 12/2011 | Marty et al. | |
| 8,139,108 | B2 | 3/2012 | Stratton et al. | |
| 8,351,684 | B2 | 1/2013 | Clar et al. | |
| 8,456,327 | B2 | 6/2013 | Bechtel et al. | |
| 8,548,691 | B2 * | 10/2013 | Hayashi | E02F 3/844 172/4.5 |
| 8,620,535 | B2 | 12/2013 | Friend et al. | |
| 9,097,520 | B2 * | 8/2015 | Stratton | G01C 7/04 |
| 2002/0162668 | A1 | 11/2002 | Carlson et al. | |
| 2004/0168358 | A1 | 9/2004 | Stump | |
| 2007/0044980 | A1 | 3/2007 | Stratton et al. | |
| 2007/0129869 | A1 * | 6/2007 | Gudat | G05D 1/0297 701/50 |
| 2008/0180523 | A1 | 7/2008 | Stratton et al. | |
| 2009/0043462 | A1 | 2/2009 | Stratton et al. | |
| 2009/0202109 | A1 | 8/2009 | Clar et al. | |
| 2010/0010703 | A1 * | 1/2010 | Coats | G05D 1/024 701/29.6 |
| 2010/0250023 | A1 | 9/2010 | Gudat | |
| 2010/0299031 | A1 | 11/2010 | Zhdanov et al. | |
| 2011/0093171 | A1 | 4/2011 | Saposnik | |
| 2012/0089293 | A1 | 4/2012 | Halder et al. | |
| 2012/0136508 | A1 * | 5/2012 | Taylor | E02F 9/2045 701/2 |
| 2012/0139325 | A1 | 6/2012 | Norberg et al. | |
| 2012/0154572 | A1 | 6/2012 | Stratton et al. | |
| 2012/0215378 | A1 | 8/2012 | Sprock et al. | |
| 2012/0271504 | A1 * | 10/2012 | Reiners | E02F 9/2054 701/29.1 |
| 2014/0012404 | A1 | 1/2014 | Taylor et al. | |
| 2014/0032030 | A1 | 1/2014 | Stratton et al. | |
| 2014/0032058 | A1 | 1/2014 | Stratton et al. | |
| 2014/0032132 | A1 | 1/2014 | Stratton et al. | |
| 2014/0180444 | A1 * | 6/2014 | Edara | G05D 1/0088 700/56 |
| 2014/0180547 | A1 * | 6/2014 | Edara | G01N 33/00 701/50 |
| 2014/0180548 | A1 * | 6/2014 | Edara | G05B 13/024 701/50 |

OTHER PUBLICATIONS

U.S. Appl. No. 14/484,548, filed Sep. 12, 2014.
U.S. Appl. No. 14/484,720, filed Sep. 12, 2014.
U.S. Appl. No. 14/484,601, filed Sep. 12, 2014.
U.S. Appl. No. 14/484,651, filed Sep. 12, 2014.
U.S. Appl. No. 14/484,549, filed Sep. 12, 2014.
U.S. Appl. No. 14/484,735, filed Sep. 12, 2014.
U.S. Appl. No. 14/484,586, filed Sep. 12, 2014.

* cited by examiner

SYSTEM AND METHOD FOR CONTROLLING THE OPERATION OF A MACHINE

TECHNICAL FIELD

This disclosure relates generally to controlling a machine and, more particularly, to a system and method for analyzing physical characteristics of a work surface and providing operating commands upon the physical characteristics meeting one or more thresholds.

BACKGROUND

Machines such as dozers, motor graders, wheel loaders, etc., are used to perform a variety of tasks. For example, these machines may be used to move material at a work site. The machines may operate in an autonomous, semi-autonomous, or manual manner to perform these tasks in response to commands generated as part of a work plan for the machines. The machines may receive instructions in accordance with the work plan to perform operations including digging, loosening, carrying, etc., different materials at the work site such as those related to mining, earthmoving and other industrial activities.

When performing slot dozing operations, material in the form of berms will be built up between slots in the work surface. It is typically desirable to periodically perform a berm reduction operation to reduce the size of the berms or clear the berms altogether. The efficiency and safety of a berm reduction operation may be dependent on the physical characteristics of the berm as well as those of the slots on opposite sides of a berm. Accordingly, it may be desirable to ensure that berm reduction operations are performed when the physical characteristics satisfy the relevant thresholds.

U.S. Patent Publication No. 2007/0129869 discloses a system for automated control of a plurality of machines at a work site. The machines may received instructions from a controller and perform certain tasks to move material or otherwise alter the topography of the work site. More than one machine may work in tandem to perform certain tasks.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a system for automated control of a machine having a ground-engaging work implement includes a position sensor for generating position signals indicative of a position of a work surface at a work site and a controller. The controller is configured to store a characteristic threshold of a pair of slots, receive a plurality of position signals from the position sensor, determine the position of the work surface along a first slot in the work site based upon the plurality of position signals to define a first slot surface, and determine the position of the work surface along a second slot in the work site based upon the plurality of position signals to define a second slot surface. The second slot is spaced from the first slot and the work surface along the first slot and the work surface along the second slot define at least a portion of a berm between the first slot and the second slot. The controller is further configured to determine a physical characteristic of the first slot and the second slot and generate a berm reduction command if the physical characteristic of the first slot and the second slot is less than the characteristic threshold of the pair of slots.

In another aspect, a controller-implemented method for automated control of a machine having a ground-engaging work implement includes storing a characteristic threshold of a pair of slots, receiving a plurality of position signals from a position sensor, determining a position of a work surface along a first slot in a work site based upon the plurality of position signals to define a first slot surface, and determining the position of the work surface along a second slot in the work site based upon the plurality of position signals to define a second slot surface. The second slot is spaced from the first slot and the work surface along the first slot and the work surface along the second slot define at least a portion of a berm between the first slot and the second slot. The method further includes determining a physical characteristic of the first slot and the second slot and generating a berm reduction command if the physical characteristic of the first slot and the second slot is less than the characteristic threshold of the pair of slots.

In still another aspect a machine includes a prime mover, a ground-engaging work implement for engaging a work surface along a path, a position sensor for generating position signals indicative of a position of a work surface at a work site, and a controller. The controller is configured to store a characteristic threshold of a pair of slots, receive a plurality of position signals from the position sensor, determine the position of the work surface along a first slot in the work site based upon the plurality of position signals to define a first slot surface, and determine the position of the work surface along a second slot in the work site based upon the plurality of position signals to define a second slot surface. The second slot is spaced from the first slot and the work surface along the first slot and the work surface along the second slot define at least a portion of a berm between the first slot and the second slot. The controller is further configured to determine a physical characteristic of the first slot and the second slot and generate a berm reduction command if the physical characteristic of the first slot and the second slot is less than the characteristic threshold of the pair of slots.

DETAILED DESCRIPTION

Figure 1:
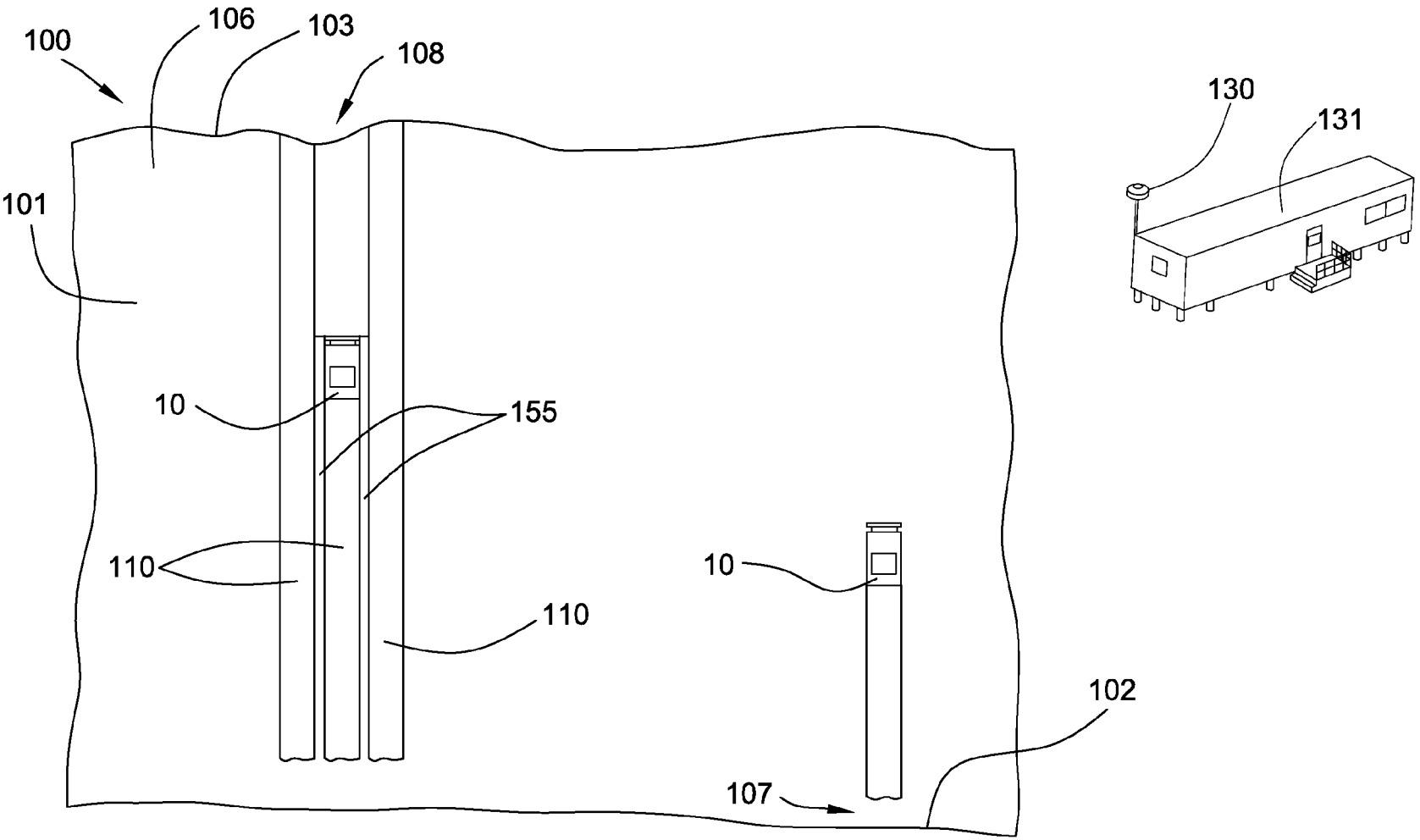
FIG. 1 depicts a schematic view of a work site at which a machine incorporating the principles disclosed herein may be used.

FIG. 1 depicts a diagrammatic illustration of a work site 100 at which one or more machines 10 may operate in an autonomous, a semi-autonomous, or a manual manner. Work site 100 may be a portion of a mining site, a landfill, a quarry, a construction site, or any other area in which movement of material is desired. Tasks associated with moving material may include a dozing operation, a grading operation, a leveling operation, a bulk material removal operation, or any other type of operation that results in the alteration of the existing topography at work site 100. As depicted, work site 100 includes a work area 101 having a high wall 102 at one end and a crest 103 such as an edge of a ridge, embankment, or other change in elevation at an opposite end. Material is moved generally from the high wall 102 towards the crest 103. The work surface 104 of the work area 101 may take any form and refers to the actual profile or position of the terrain of the work area.

As used herein, a machine 10 operating in an autonomous manner operates automatically based upon information received from various sensors without the need for human operator input. As an example, a haul or load truck that automatically follows a path from one location to another and dumps a load at an end point may be operating autonomously. A machine operating semi-autonomously includes an operator, either within the machine or remotely, who performs some tasks or provides some input and other tasks are performed automatically and may be based upon information received from various sensors. As an example, a load truck that automatically follows a path from one location to another but relies upon an operator command to dump a load may be operating semi-autonomously. In another example of a semi-autonomous operation, an operator may dump a bucket of an excavator in a load truck and a controller may automatically return the bucket to a position to perform another digging operation. A machine being operated manually is one in which an operator is controlling all or essentially all of the functions of the machine. A machine may be operated remotely by an operator (i.e., remote control) in either a manual or semi-autonomous manner.

Figure 2:
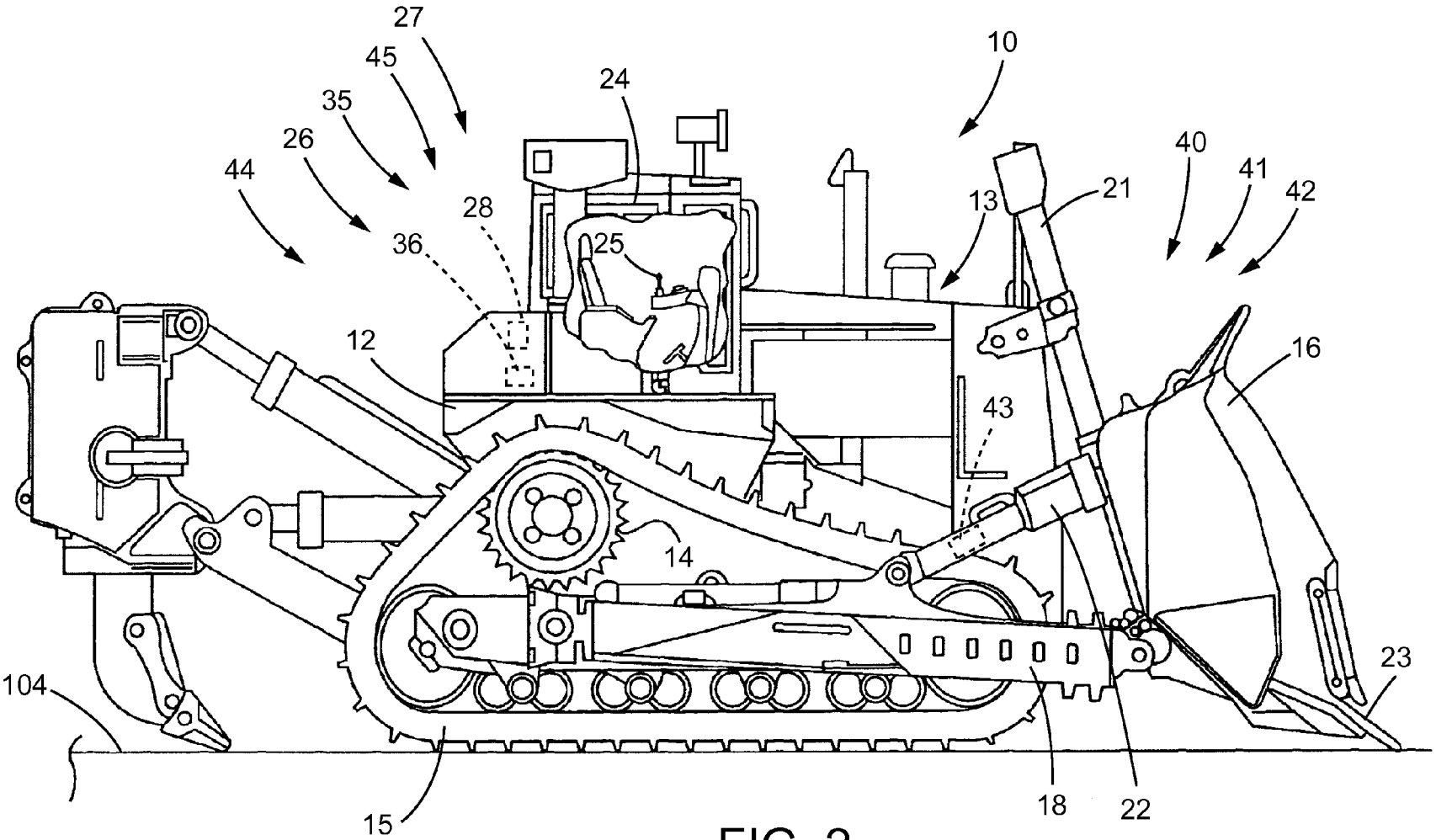
FIG. 2 depicts a diagrammatic illustration of a machine in accordance with the disclosure.

FIG. 2 depicts a diagrammatic illustration of a machine 10 such as a dozer with a ground-engaging work implement such as a blade 16 configured to push material. The machine 10 includes a frame 12 and a prime mover such as an engine 13. A ground-engaging drive mechanism such as a track 15 may be driven by a drive sprocket 14 on opposite sides of machine 10 to propel the machine. Although machine 10 is shown in a "track-type" configuration, other configurations, such as a wheeled configuration, may be used. Operation of the engine 13 and a transmission (not shown), which are operatively connected to the drive sprockets 14 and tracks 15, may be controlled by a control system 35 including a controller 36. The systems and methods of the disclosure may be used with any machine propulsion and drivetrain mechanisms applicable in the art for causing movement of the machine including hydrostatic, electric, or mechanical drives.

Blade 16 may be pivotally connected to frame 12 by arms 18 on each side of machine 10. First hydraulic cylinder 21 coupled to frame 12 supports blade 16 in the vertical direction and allows blade 16 to move up or down vertically from the point of view of FIG. 2. Second hydraulic cylinders 22 on each side of machine 10 allow the pitch angle of blade tip 23 to change relative to a centerline of the machine.

Machine 10 may include a cab 24 that an operator may physically occupy and provide input to control the machine. Cab 24 may include one or more input devices such as joystick 25 through which the operator may issue commands to control the propulsion system and steering system of the machine as well as operate various implements associated with the machine.

Machine 10 may be controlled by a control system 35 as shown generally by an arrow in FIG. 2 indicating association with the machine 10. The control system 35 may include an electronic control module or controller 36 and a plurality of sensors. The controller 36 may receive input signals from an operator operating the machine 10 from within cab 24 or off-board the machine through a wireless communications system 130 (FIG. 1). The controller 36 may control the operation of various aspects of the machine 10 including the drivetrain and the hydraulic systems.

The controller 36 may be an electronic controller that operates in a logical fashion to perform operations, execute control algorithms, store and retrieve data and other desired operations. The controller 36 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller 36 such as power supply circuitry, signal conditioning circuitry, driver circuitry, and other types of circuitry.

The controller 36 may be a single controller or may include more than one controller disposed to control various functions and/or features of the machine 10. The term "controller" is meant to be used in its broadest sense to include one or more controllers and/or microprocessors that may be associated with the machine 10 and that may cooperate in controlling various functions and operations of the machine. The functionality of the controller 36 may be implemented in hardware and/or software without regard to the functionality. The controller 36 may rely on one or more data maps relating to the operating conditions and the operating environment of the machine 10 and the work site 100 that may be stored in the memory of controller. Each of these data maps may include a collection of data in the form of tables, graphs, and/or equations.

The control system 35 and the controller 36 may be located on the machine 10 and may also include components located remotely from the machine such as at a command center 131 (FIG. 1). The functionality of control system 35 may be distributed so that certain functions are performed at machine 10 and other functions are performed remotely. In such case, the control system 35 may include a communications system such as wireless communications system 130 for transmitting signals between the machine 10 and a system located remote from the machine.

Machine 10 may be configured to be operated autonomously, semi-autonomously, or manually. When operating semi-autonomously or manually, the machine 10 may be operated by remote control and/or by an operator physically located within the cab 24.

Machine 10 may be equipped with a plurality of machine sensors 26, as shown generally by an arrow in FIG. 2 indicating association with the machine 10, that provide data indicative (directly or indirectly) of various operating parameters of the machine and/or the operating environment in which the machine is operating. The term "sensor" is meant to be used in its broadest sense to include one or more sensors and related components that may be associated with the machine 10 and that may cooperate to sense various functions, operations, and operating characteristics of the machine and/or aspects of the environment in which the machine is operating.

A position sensing system 27, as shown generally by an arrow in FIG. 2 indicating association with the machine 10, may include a position sensor 28, also shown generally by an arrow in FIG. 2 to indicate association with the machine, to sense the position and orientation (i.e., the heading, pitch, roll or tilt, and yaw) of the machine relative to the work site 100. The position and orientation of the machine 10 are sometimes collectively referred to as the position of the machine. The position sensor 28 may include a plurality of individual sensors that cooperate to generate and provide a plurality of position signals to controller 36 indicative of the position and orientation of the machine 10. In one example, the position sensor 28 may include one or more sensors that interact with a positioning system such as a global navigation satellite system or a global positioning system to operate as a position sensor. In another example, the position sensor 28 may further include a slope or inclination sensor such as pitch angle sensor for measuring the slope or inclination of the machine 10 relative to a ground or earth reference. The controller 36 may use position signals from the position sensors 28 to determine the position of the machine 10 within work site 100. In other examples, the position sensor 28 may include an odometer or another wheel rotation sensing sensor, a perception based system, or may use other systems such as lasers, sonar, or radar to determine all or some aspects of the position of machine 10.

In some embodiments, the position sensing system 27 may include a separate orientation sensing system. In other words, a position sensing system may be provided for determining the position of the machine 10 and a separate orientation sensing system may be provided for determining the orientation of the machine.

If desired, the position sensing system 27 may also be used to determine a ground speed of machine 10. Other sensors or a dedicated ground speed sensor may alternatively be used to determine the ground speed of the machine 10.

Machine 10 may be configured to move material at the work site 100 according to one or more material movement plans from an initial location 107 to a spread or dump location 108. The dump location 108 may be at crest 103 or at any other location. The material movement plans may include, among other things, forming a plurality of spaced apart channels or slots 110 that are cut into the work surface 104 at work site 100 along a path from the initial location 107 to the dump location 108. In doing so, each machine 10 may move back and forth along a linear path between the initial location 107 and the dump location 108. If desired, a relatively small amount of material may be left or built up as walls or berms 155 between adjacent slots 110 to prevent or reduce spillage and increase the efficiency of the material moving process. The berms 155 between the slots 110 may be removed after the slots are formed or periodically as discussed below. The process of moving material through slots 110 while utilizing berms 155 of material to increase the efficiency of the process is sometimes referred to as "slot dozing."

Figure 3:
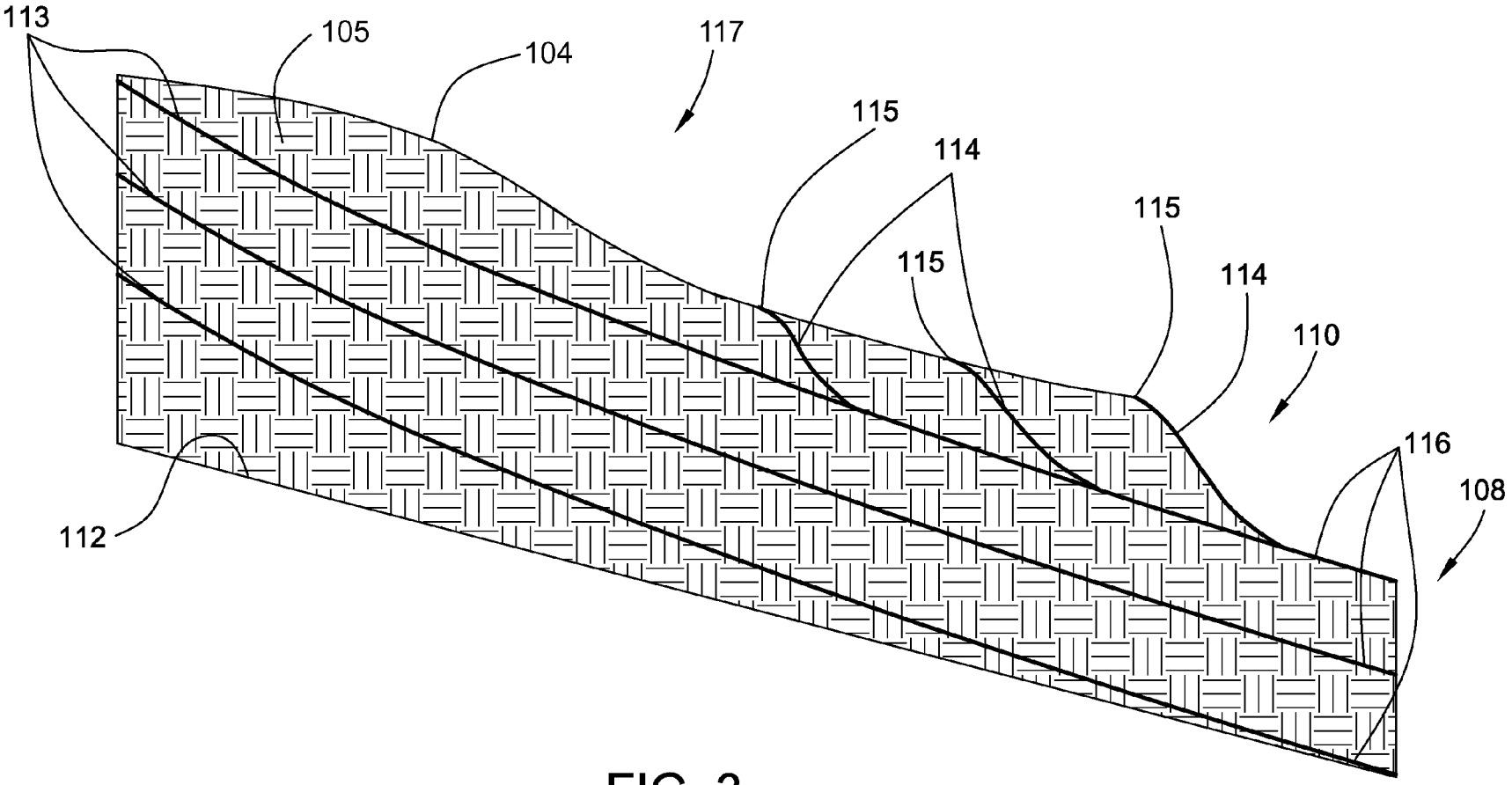
FIG. 3 depicts a cross-section of a portion of a work site depicting various aspects of a material moving plan.

As depicted in FIG. 3, in one embodiment, each slot 110 may be formed by removing material 105 from the work surface 104 in one or more layers or passes 113 until the final work surface or final design plane 112 is reached. The blade 16 of machine 10 may engage the work surface 104 with a series of cuts 114 that are spaced apart lengthwise along the slot 110. Each cut 114 begins at a cut location 115 along the work surface 104 at which the blade 16 engages the work surface and extends into the material 105 and moves towards the pass target or carry surface 116 for a particular pass. Controller 36 may be configured to guide the blade 16 along each cut 114 until reaching the carry surface 116 and then follow the carry surface towards the dump location 108.

Figure 4:
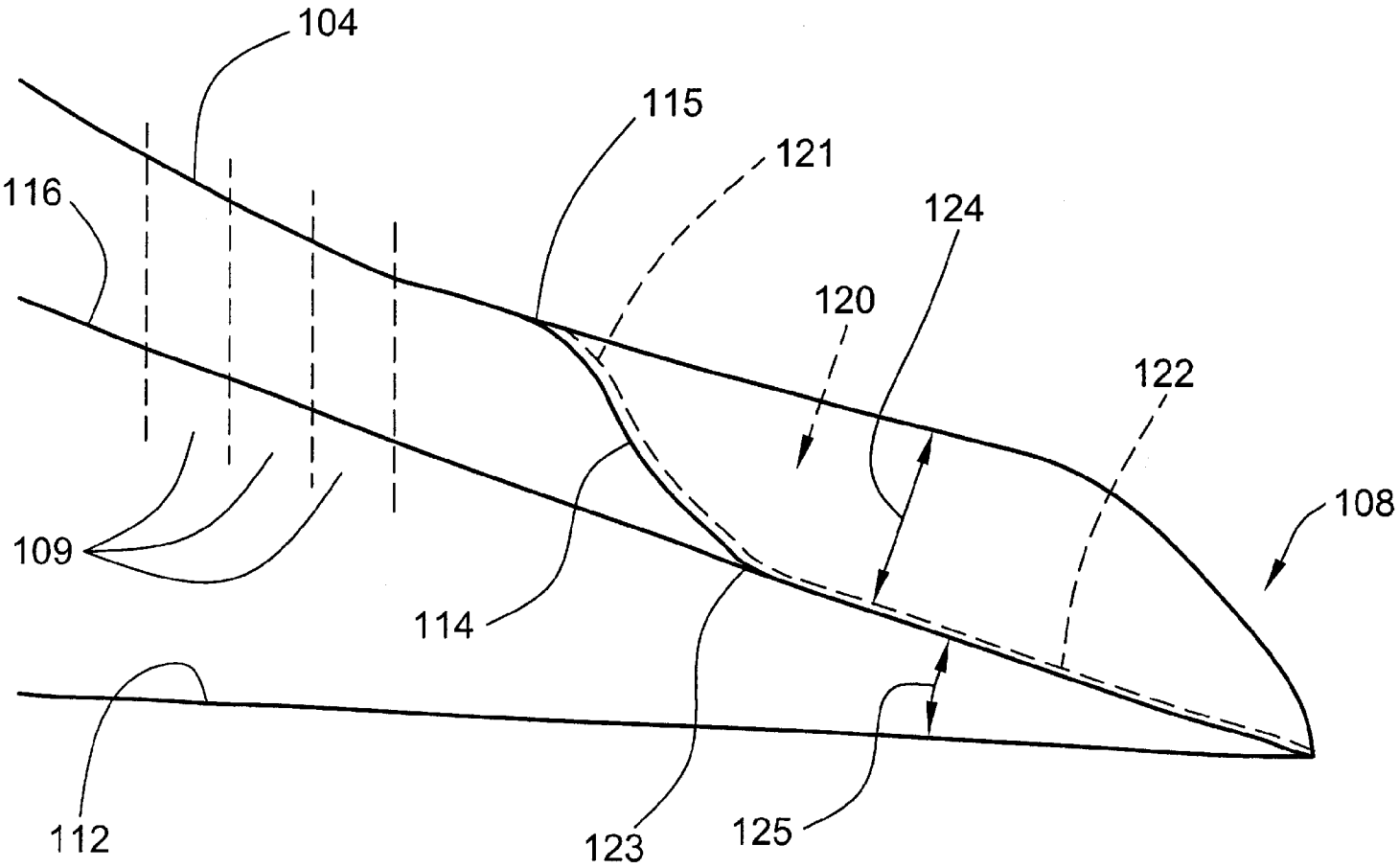
FIG. 4 depicts a diagrammatic cross-section of a portion of a work site depicting a potential target profile.

During each material moving pass, the controller 36 may guide the blade 16 generally along a desired path or target profile depicted by dashed line 120 in FIG. 4 from the cut location 115 to the dump location 108. A first portion of the target profile 120 extends from the cut location 115 to the carry surface 116. The first portion may be referred to as the loading profile 121 as that is the portion of the target profile 120 at which the blade 16 is initially loaded with material. A second portion of the target profile 120 extends from the intersection 123 of the cut 114 and the carry surface 116 to the dump location 108. The second portion may be referred to as the carry profile 122 as that is the portion of the target profile 120 at which the blade 16 carries the load along the carry surface 116.

The first portion or loading profile 121 may have any configuration and, depending on various factors including the configuration of the work surface 104 and the type of material to be moved, some cut profiles may be more efficient than others. The loading profile 121 may be formed of one or more segments that are equal or unequal in length and with each having different or identical shapes. These shapes may be linear, symmetrically or asymmetrically curved, Gaussian-shaped or any other desired shape. In addition, the angle of any of the shapes relative to the work surface 104 or the final design plane 112 may change from segment to segment.

The second portion or carry profile 122 may have any configuration but is often generally linear and sloped downward so that movement of material will be assisted by gravity to increase the efficiency of the material moving process. In other words, the carry profile 122 is often configured so that it slopes downward towards the dump location 108. The characteristics of the carry profile 122 (sometimes referred to as the slot parameters) may define the shape of the carry surface 116, the depth of the carry surface 116 below an uppermost surface of the work surface 104 as indicated by reference number 124, and the angle of the carry surface as indicated by reference number 125. In some instances, the angle 125 of the carry surface 116 may be defined relative to a gravity reference or relative to the final design plane 112.

Although it may be generally desirable for the blade 16 to follow the target profile 120, performance characteristics of the machine 10, characteristics of the material 105, and/or desired operating efficiencies may cause a deviation from the target profile 120. More specifically, as blade 16 makes a cut 114, the load on the blade will increase. Further, as the blade 16 travels along the carry surface 116, the load on the blade may continue to increase. If the blade 16 is overloaded for a particular slope, the machine 10 may slip and/or cause excess wear on the machine. Accordingly, the control system 35 may include a blade control system 40 to improve the efficiency of the material moving process.

In one embodiment, the blade control system 40 may control the load on the blade 16 so that the torque generated by the machine 10 is generally maintained at or about a predetermined value. In one example, it may be desirable to maintain the load on the machine 10 at approximately 80% of its maximum torque. In other examples, it may be desirable to maintain the load within a range of approximately 70-90% of the maximum torque. Other values and ranges are contemplated. In order to maintain the load at a desired value or within a desired range, the blade control system 40 may raise or lower the blade 16 to decrease or increase the amount of material carried by the blade 16 and thus decrease or increase the load.

The control system 35 may include an implement load monitoring system 41 shown generally by an arrow in FIG. 2. The implement load monitoring system 41 may include a variety of different types of implement load sensors depicted generally by an arrow in FIG. 2 as an implement load sensor system 42 to measure the load on the blade 16. In one embodiment, the implement load sensor system 42 may embody one or more pressure sensors 43 for use with one or more hydraulic cylinder, such as second hydraulic cylinders 22, associated with blade 16. Signals from the pressure sensor 43 indicative of the pressure within the second hydraulic cylinders 22 may be monitored by controller 36. Other ways of determining a change in cylinder pressure associated with a change in the load on blade 16 are contemplated, including other ways of measuring the pressure within second hydraulic cylinders 22 and measuring the pressure within other cylinders associated with the blade. The load on the blade 16 may be correlated to the load on the engine 13 by controller 36.

The load on the blade 16 may be affected by the slope of the terrain upon which the machine 10 is moving. Accordingly, if desired, the accuracy of the implement load measurement may be increased by utilizing the implement load sensor system 42 in conjunction with a slope or inclination sensor such as a pitch angle sensor. For example, if the machine 10 is moving uphill, the load on the blade 16 may be higher due to gravity as compared to a machine operating in the same conditions on flat terrain. Similarly, the load on the blade 16 may be lower for the same mass or volume when the machine in moving downhill. By determining the slope of the terrain, the controller 36 may more accurately determine changes in the load on the blade 16.

As used herein, the word "uphill" refers to a direction towards the high wall 102 relative to the crest 103 or dump location 108. Similarly, the word "downhill" refers to a direction towards the crest 103 or dump location 108 relative to the high wall 102.

If desired, control system 35 may also include a machine load monitoring system 44 that may be used by the blade control system 40. In one embodiment, the machine load monitoring system 44 may utilize an engine speed sensor (not shown) and a torque converter speed sensor (not shown) to measure a difference between the speed of the engine 13 and a torque converter (not shown) to determine the load on the machine 10.

Control system 35 may include a module or planning system 45 for determining or planning various aspects of the excavation plan. The planning system 45 may receive and store various types of input such as the configuration of the work surface 104, the final design plane 112, a desired loading profile 121, a desired carry profile 122, and characteristics of the material to be moved. Operating characteristics and capabilities of the machine 10 such as maximum load may also be entered into the planning system 45. The planning system 45 may simulate the results of cutting the work surface 104 at a particular cut location and for a particular target profile, and then choose a cut location that creates the most desirable results based on one or more criteria. In one embodiment, the planning function may be performed while operating the machine 10. In another embodiment, some or all aspects of the planning function may be performed ahead of time and the various inputs to the planning system 45 and the resultant cut locations, target profiles, and related data stored as part of the data maps of the controller 36.

Referring to FIGS. 3 and 4, a potential cut 114 at work site 100 that may be generated by control system 35 is illustrated. Work surface 104 represents the uppermost height of the existing material 105 at the slot 110. While the illustration is depicted in two dimensions, it should be appreciated that the data representing the illustration may be in three dimensions. In one example, the path 117 along slot 110 may be divided into a plurality of increments 109 (FIG. 4) and data stored within controller 36 for each increment. The controller 36 may store information or characteristics of the increment 109 such as the length of the work surface and its angular orientation relative to a ground reference, the material characteristics of the material 105 beneath the work surface, a time stamp or indicator of the age of the data, and any other desired information. The information regarding each path 117 may be stored within an electronic map within controller 36 as part of a topographical map of the work site 100.

Information regarding each path 117 may be obtained according to any desired method. In one example, the machine 10 may utilize the position sensing system 27 described above to map out the contour of work surface 104 as machine 10 moves across it. This data may also be obtained according to other methods such as by a vehicle that includes lasers and/or cameras. It should be noted that as the machine 10 moves material 105 to the dump location 108, the position of the work surface 104 will change and may be updated based upon the current position of the machine 10 and the position of the blade 16.

As may be seen in FIG. 4, moving the blade 16 along the target profile 120 will result in a volume of material 105 being moved from slot 110. The planning system 45 may use the shape of the loading profile 121 and the cut location 115 to determine the volume of material that would be moved by blade 16 if the machine 10 were to follow the target profile 120. More specifically, the planning system 45 may use three-dimensional data that represents the machine 10, the work surface 104, and the target profile 120 to make a volumetric calculation of the volume of material that will be moved for a particular target profile 120.

Figure 6:
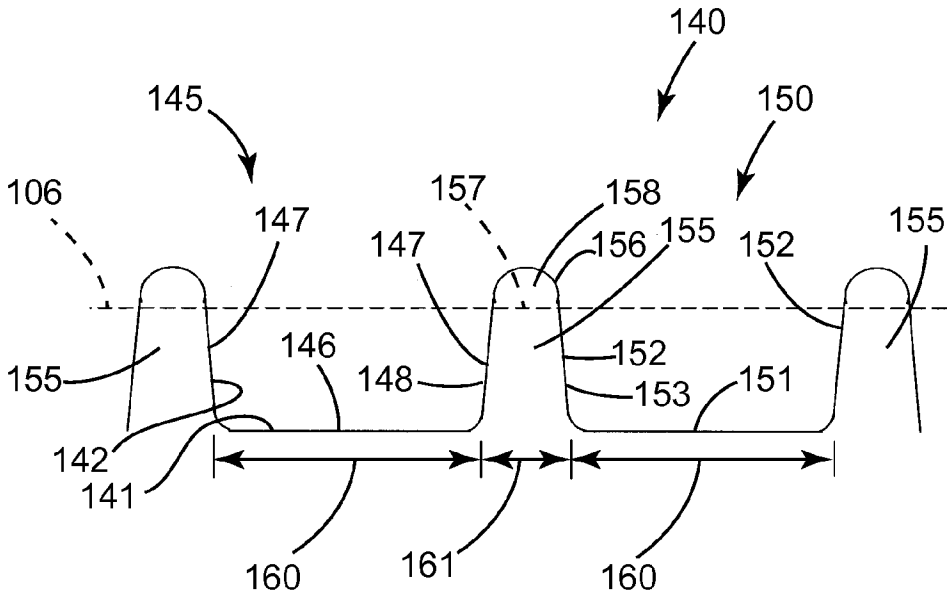
FIG. 6 depicts a cross-section of the pair of slots of FIG. 5 taken generally along line 6-6.
Figure 5:
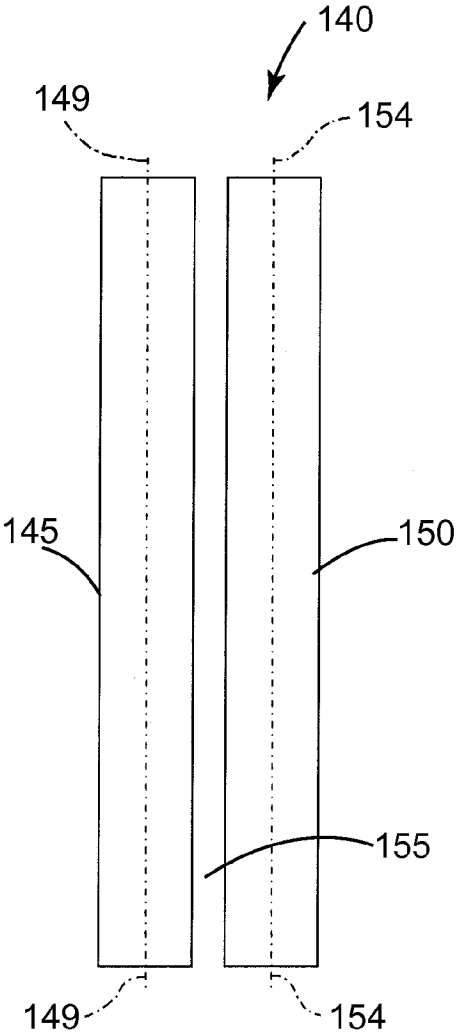
FIG. 5 depicts a schematic top plan view of a pair of slots at a work site.

When performing slot dozing operations, a first slot 145 and an adjacent second slot 150 may be formed with material 105 left between the pair of slots 140 in the form of a berm 155 as depicted in FIGS. 5-6. The berms 155 assist in the slot dozing process by limiting the amount of material 105 that can move sideways or laterally relative to the blade 16 as the machine 10 pushes the material down each path 117 to form slot 110.

More specifically, before beginning a slot dozing operation, the work surface 104 may have a generally uniform original elevation or original work surface depicted by dashed line 106 in FIG. 5. During a slot dozing process, most of the material 105 being cut or moved by the blade 16 of machine 10 as it moves down the path 117 will be moved through the slot 110 along its lower surface 141 to the dump location 108 and will be guided by the boundary formed by the sidewalls 142 of each slot.

As a slot 110 is formed, the work surface 104 at the slot is defined by the lower surface 141 and the opposed sidewalls 142. Material 105 between the slots 110 may be left as berms 155. The additional material moved from the slot 110 onto the original surface 157 of the berm 155 is identified by reference number 158.

It is typically desirable to periodically reduce the height of the berms 155 between adjacent pairs of slots 140. In some instances, it may be desirable to remove the berms 155 altogether to create a relatively flat surface. The control system 35 may include a planning system 45 that operates to initially evaluate the appropriateness or desirability of a berm reduction operation.

Before permitting a berm reduction operation, the planning system 45 may evaluate certain physical characteristics of a pair of slots 140 and/or the berm 155 and compare them to a relevant characteristic threshold to determine whether the machine 10 is capable of performing a berm reduction operation in a safe and efficient manner. In other words, the planning system 45 may determine whether the machine 10 is likely to encounter any difficulty or potentially dangerous conditions based upon the configuration of the pair of slots 140 on opposite sides of the berm 155 and/or the berm itself.

It should be noted that while the planning system may operate by evaluating certain physical characteristics of a pair of slots 140, the planning system may alternatively or additionally evaluate the physical characteristics of the berm 155. In many instances, since machines 10 will travel along the paths 117 defined by the slots 140, the controller 36 may directly determine the physical characteristics of the slots by mapping their physical characteristics as the machine travels down the slots. The physical characteristics of the berm 155 may generally be derived from the positions of the slots 110. More specifically, first slot 145 includes a first slot surface defined by a first slot lower surface 146 and a pair of opposed sidewalls 147. Second slot 150 includes a second slot surface defined by a second slot lower surface 151 and a pair of opposed sidewalls 152. A first slot sidewall 148 of the first slot 145 positioned closest to the second slot 150 and a second slot sidewall 153 of the second slot 150 positioned closest to the first slot 145 define the sidewalls of the berm. As a result, the position of the berm 155 may be determined from the positions of the pair of adjacent slots.

It should be noted that mapping a pair of slots 140 may not, however, define the height of the berm as the positions of the sidewalls 142 of the slots 140 will not indicate how much additional material 158 has remained on top of the original surface 157 of the berm 155. In addition, the mapping process may not identify the exact location of the sidewalls 142 of the slots 140 as mapping of the slots may not indicate how much material has fallen back into the slots 140 along the sidewalls 142. In some instances, machine 10 or other machines may include proximity sensors or other sensors to directly measure the position of the sidewalls 142 of the slot 140 as well as the position of the additional material 158 of berm 155.

The planning system 45 may be configured to evaluate the appropriateness of a berm reduction operation based upon evaluating or analyzing one or more physical characteristics of a pair of adjacent slots, the physical characteristics of the berm 155 between the slots, or a combination of the two. Further, the planning system 45 may operate to do so regardless of the manner in which the physical characteristics are determined. However, since the physical characteristics of the pair of slots may be derived from the physical characteristics of the berm, the planning system is described herein in terms of the physical characteristics of the pair of slots. In other words, in addition to or instead of evaluating the characteristics of the pair of slots 140, the planning system 45 may operate by evaluating the characteristics of the berm. However, since the characteristics of the berm may be derived from the characteristics of a pair of adjacent slots, reference herein to the characteristics of a pair of slots 140 may also include the characteristics of the berm and an evaluation of the characteristics of a pair of slots may also include an evaluation of the characteristics of the berm between the slots.

One physical characteristic of the pair of slots 140 that may be evaluated by the planning system 45 is the width of berm 155. The width of the berm 155 may be determined or defined in many different manners. In one example, the width of the berm 155 may be determined by calculating the distance between adjacent sidewalls 142 of the pair of slots 140 (first slot sidewall 148 and second slot sidewall 153) that define the sidewalls of the berm.

Another manner of determining the width of the berm is based upon the distance between centerlines of the first slot and the second slot. More specifically, the controller 36 may determine the width of the berm by determining the distance between the first centerline 149 of the first slot 145 and second centerline 154 of the second slot 150 and subtracting a distance equal to the width of blade 15. Referring to FIG. 6, the width of each slot 110 is depicted at 160 and the width of the berm 155 is depicted at 161.

A berm width threshold may be stored in controller 36 and specifies the maximum width for the berm. Regardless of the manner in which the berm width is calculated, if the width of the berm 155 is greater than the berm width threshold, the controller 36 may be configured to prevent the generation of a berm reduction command. In one example, the berm width threshold may be approximately ⅓ of the width of the blade 16. In other example, the berm width threshold may be set as a larger or smaller distance.

The planning system 45 may include the restriction on berm width due to restrictions on the ability of the machine to efficiently cut a berm 155 that is wider than the berm width threshold.

Figure 7:
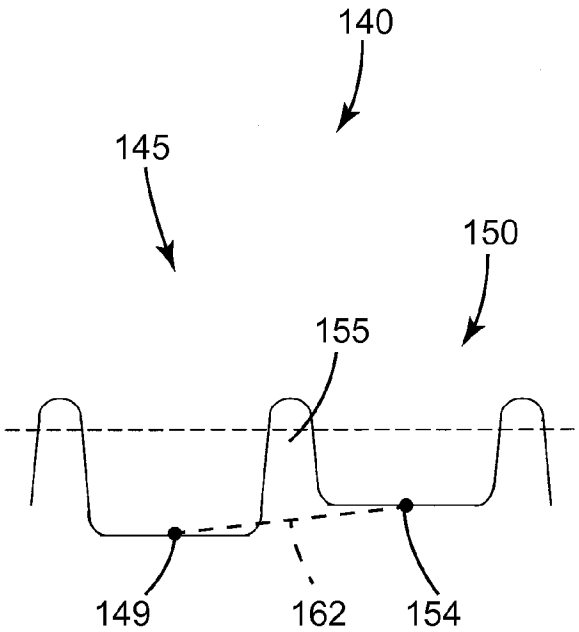
FIG. 7 depicts a cross-section of a pair of slots similar to FIG. 6 but with the lower surfaces of the slots offset.

Another physical characteristic of the pair of slots 140 that may be analyzed by the planning system 45 is the difference between the depths of the first slot 145 and the second slot 150. The first slot 145 has a first slot lower surface 146 and the second slot 150 has a second slot lower surface 151 and the controller 36 may be configured to determine a difference in depth between the first slot lower surface and the second slot lower surface. As depicted in FIG. 7, the first slot lower surface 142 of the first slot 145 is somewhat lower than the second slot lower surface 151 of the second slot 150. As a result, a machine 10 operating to reduce or remove the berm 155 at the depicted cross-section will be operating at an angle as the tracks 15 of the machine engage the respective lower surfaces of the slots.

A difference in depth threshold may be stored within controller 36 and specifies the maximum difference between the depths of the pair of slots 140. In one embodiment, the difference in depth threshold may be expressed as an angle. In doing so, the controller 36 may be configured to draw a line as depicted at 162 between the first centerline 149 of the first slot 145 and the second centerline 154 of the second slot 150 and compare the angle of the line 162 to a generally horizontal line. In one example, the angle may be expressed as a specific number (e.g., 20 degrees).

In another example, a rollover angle may be stored within controller 36 that corresponds to the rollover threshold of the type of machine 10 operating to perform the berm reduction operation. More specifically, each type of machine that may operate at the work site 100 to reduce or clear a berm 155 may have a specific rollover threshold based upon the configuration and characteristics of the machine. In such case, the difference in depth threshold may be set based upon the rollover angle for each specific machine. In still another example, the difference in depth threshold may be expressed as a distance (e.g. 1 m). The planning system 45 may be configured to prevent a berm reduction process if the difference in depth between the lower surfaces of the pair of slots 140 exceeds the difference in depth threshold.

The planning system 45 may include the restriction on the difference in depth to reduce the likelihood that the machine 10 performing the berm reduction operation will encounter a situation in which it may tip over. Accordingly, in some embodiments, the planning system 45 may prevent a berm reduction operation if the difference in depth between the first slot 145 and second slot 150 exceeds the difference in depth threshold at any point or location along the path 117 of the pair of slots 140. In other embodiments, the planning system 45 may prevent a berm reduction operation if the difference in depth exceeds the threshold for more than a predetermined length (e.g., 1 m) along the pair of slots 140. In still another embodiment, the planning system 45 may rely upon an average difference in depth over a specified length of the pair of slots 140. In addition, the difference in depth threshold may vary or change along the paths 117 of the pair of slots 140.

Figure 8:
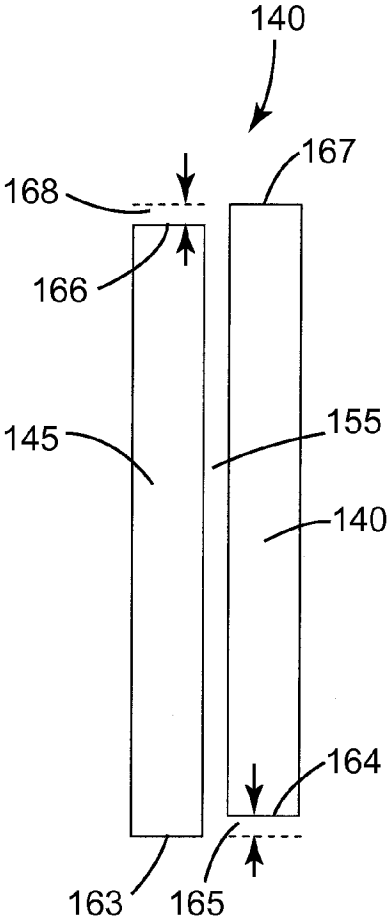
FIG. 8 depicts a schematic top plan view of a pair of slots similar to FIG. 5 but with the start and end locations of the slots offset.

Another physical characteristic of the pair of slots 140 that may be analyzed by the planning system 45 is a difference in start locations between the first slot 145 and the second slot 150. Referring to FIG. 8, the first slot 145 includes a first start location 163 and the second slot 150 includes a second start location 164. The controller 36 may be configured to determine a difference between the first start location 163 and the second start location 164 along the paths 117 of the slots 110. As depicted in FIG. 8, the first slot 145 has a first start location 163 that begins somewhat before the second start location 164 of the second slot 150. The longitudinal distance of the offset between the first start location 163 and second start location 164 is depicted at 165.

A berm start offset threshold may be stored within controller 36 and specifies the maximum difference between the start offset of the pair of slots 140 on opposite sides of berm 155. In one embodiment, a berm start location threshold may be expressed as a distance. For example, the planning system 45 may prevent a berm reduction operation if the difference in start locations or offset 165 between the first start location 163 and the second start location 164 exceeds a predetermined distance such as 1 m. In an alternate embodiment, the berm start offset threshold may be expressed as an angle in a manner similar to that described above with respect to the difference in depth threshold. As such, the berm start offset threshold may also be a function of a rollover threshold of the machine 10.

The planning system 45 may include the restriction on the berm start location to reduce the likelihood that the machine 10 performing the berm reduction operation will encounter an unsafe condition such as one in which it may tip over. For example, if a machine 10 is attempting to enter a pair of slots 140 that have different start locations, the machine may tip as it begins to enter only one of the pair of slots. Setting a threshold for a permitted offset may increase the safety of operating the machine 10.

Still another physical characteristic of the pair of slots 140 that may be analyzed by the planning system 45 is a difference in end locations between the first slot 145 and the second slot 150. As depicted in FIG. 8, the first slot 145 includes a first end location 166 and the second slot 150 includes a second end location 167. The controller 36 may be configured to determine a difference between the first end location 166 and the second end location 167 along the paths 117 of the slots 110. The first slot 145 is depicted in FIG. 8 as having a first end location 166 that ends somewhat before the second end location 167 of the second slot 150. The longitudinal distance of the offset between the first end location 166 and second end location 167 is depicted at 168.

A berm end offset threshold may be stored within controller 36 and specifies the maximum difference between the end offset of the pair of slots 140 on opposite sides of berm 155. In one embodiment, a berm end location threshold may be expressed as a distance. For example, the planning system 45 may prevent a berm reduction operation if the difference in end locations or offset 168 between the first end location 166 and the second end location 167 exceeds a predetermined distance such as 1 m. In an alternate embodiment, the berm end offset threshold may be expressed as an angle in a manner similar to that described above with respect to the difference in depth threshold and the berm start offset threshold. As such, the berm end offset threshold may also be a function of a rollover threshold of the machine 10.

The planning system 45 may include the restriction on the berm end location to improve the efficiency and the safety of the berm clearing process. For example, the planning system 45 may be configured to direct the machine 10 terminate or truncate a berm reduction operation before reaching the end locations of the pair of slots 140 if the offset 168 exceeds the berm end offset threshold. In other words, if the planning system 45 permitted the machine 10 to reach the offset end locations, the machine 10 may be at risk of tipping over. However, if the machine 10 is stopped before reaching the offset end locations, the likelihood of the machine 10 tipping is reduced but the full length of the berm 155 will not be reduced or cleared.

Figure 9:
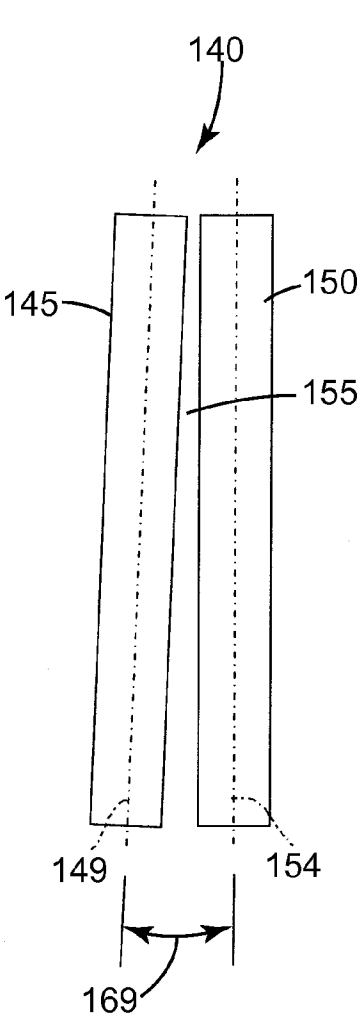
FIG. 9 depicts a schematic top plan view of a pair of slots similar to FIG. 5 but with the centerlines of the pair of slots at an angle to each other.

An additional physical characteristic of the pair of slots 140 that may be analyzed by the planning system 45 is an angle between the first slot 145 and the second slot 150. More specifically, as depicted in FIG. 9, the controller 36 may be configured to determine the difference in angular orientation between the first centerline 149 of the first slot 145 and the second centerline 154 of the second slot 150. In doing so, the controller 36 may be configured to determine the extent to which the centerlines are not parallel.

An angular orientation threshold may be stored within controller 36 and specifies the maximum extent that the slots 110 may vary from parallel. To the extent that the slots 110 are not parallel, the width of the berm 155 will change along the pair of slots 140 and thus may increase the complexity of the berm reduction process. Accordingly, the angular orientation threshold may be set as a predetermined number of degrees, but such number may depend upon the length of the slots 110. For example, a relatively small difference in angular orientation (2-3 degrees) between the first centerline 149 of the first slot 145 and the second centerline 154 of the second slot 150 may be acceptable in many operations. A difference in angular orientation of approximately 5 degrees may be unacceptable for relatively long pairs of slots 140 and a difference in angular orientation of approximately 10 degrees may be acceptable for a relatively short pairs of slots. In FIG. 9, it may be seen that the first slot 145 is angled towards the second slot 150 and the extent that the slots vary from parallel is depicted at 169.

The planning system 45 may be configured to require the physical characteristics of the pair of slots 140 meet all or any combination of the slot physical characteristic thresholds before permitting a berm reduction command to proceed. For example, in some instances, the planning system 45 may be configured to require that all of the thresholds that are directed to safety issues be met but only require some of the thresholds directed to the efficiency of operation. In other instances, the planning system 45 may require all of the thresholds to be met.

Figure 10:
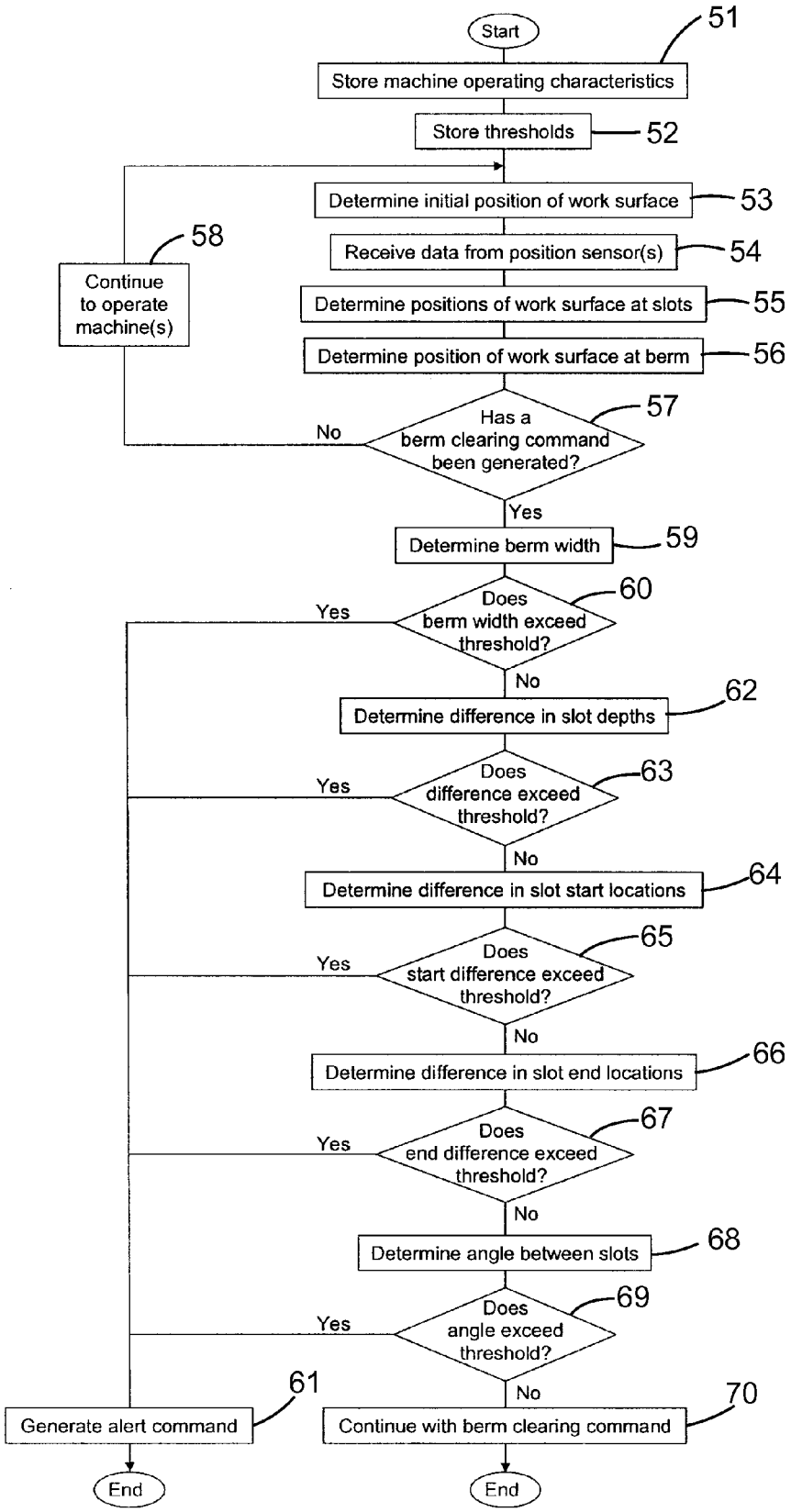
FIG. 10 depicts a flowchart illustrating the berm reduction process in accordance with the disclosure.

The flowchart in FIG. 10 depicts a process in which the planning system 45 may approve or disapprove of a commanded berm clearing or reducing operation. The process is applicable regardless of whether the command to modify the berm was generated autonomously by another aspect of the planning system 45 or manually by an operator or other personnel. At stage 51, operating characteristics of machine 10 may be entered into controller 36. The operating characteristics may include a desired maximum load on the machine 10 and the dimensions of the machine including those of blade 16.

At stage 52, a plurality of thresholds may be set or stored within controller 36. These thresholds may include the difference in depth threshold. the berm start offset threshold. the berm end offset threshold, and the angular orientation difference threshold. Each of these thresholds may be set or stored by an operator, management personnel, other personnel, or may be preset as a default within the planning system 45.

The initial position or configuration of the work surface 104 may be determined at stage 53. The configuration of the work surface 104 may be determined in any desired manner including moving machines autonomously about the work site 100. In an alternate process, an operator may manually operate machines 10, either from within the cab 24 of the machine or by remote control, and the topography of the work site 100 recorded. In another alternate embodiment, an electronic map of the work site 100 may be generated by moving a mapping vehicle (not shown) about the work site. As the machine 10 moves along the path 117, the position of the machine may be used to determine the position of the work surface 104 and update the electronic map of the work site 100 within controller 36.

The controller 36 may receive at stage 54 data from the position sensor 28. At stage 55, the controller 36 may determine the position of the machine 10 based upon the data from the position sensor 28.

As the machine 10 is moved along each slot 110, the controller 36 may determine at stage 56 the position of the work surface 104 along each slot. More specifically, the controller 36 may determine, based upon the known dimensions of the machine 10, the position of the lower surface and the sidewalls of each slot 110.

By storing the configuration of the slots 110 as part of an electronic map within the controller 36, the controller may also determine at stage 56 the dimensions of the berm 155. The position of the lower surface 141 and the sidewalls 142 of each slot 110 will establish the lower boundary and width 161 of the berm 155. It should be noted, however, that the controller 36 may not be able to determine the amount of additional material 158 on top of the berm 155 deposited by the slot dozing operation. Proximity sensors may be included as part of control system 35 to provide additional or confirmatory information regarding the dimensions of the berm 155.

At decision stage 57, the controller 36 may determine whether a berm reduction command for reducing the height of or clearing the berm 155 altogether has been generated. In some instances, the berm reduction command may be generated by the planning system 45 based upon the configuration of the pair of slots 140 and the berm 155. For example, certain combinations of slot depths and berm width may result in such a berm reduction command. In other instances, the berm reduction command may be generated by an operator or other personnel based upon observed characteristics of the pair of slots 140 and berm 155 or for any other reason.

If a berm reduction command has not been generated, one or more machines 10 may continue to be operated at stage 58, either autonomously or manually. The process of stages 53-57 may be repeated until a berm reduction command is generated.

If a berm reduction command has been generated at decision stage 57, the planning system 45 may proceed with analyzing various physical characteristics of the pair of slots 140 and berm 155 to determine whether the berm reduction or clearing process may continue in an efficient and safe manner.

At stage 59, the controller 36 may determine the width 161 of the berm 155 based upon the position the sidewalls 142 of the slots 140. At decision stage 60, the controller 36 may determine whether the width of the berm 155 exceeds the berm width threshold. If the width 161 of the berm 155 exceeds the berm width threshold, the controller 36 may generate an alert command at stage 61. The alert command may be configured as a notification to an operator or other personnel, or may be configured as any other desired command. The alert command may identify the specific threshold that has not been met, if desired, so that an operator or other personnel may modify the topography of the work site 100 to permit a berm clearing operation.

If the width of the berm 155 does not exceed the berm width threshold at decision stage 60, the controller 36 may determine at stage 62 the difference in the depth of the pair of slots 140. More specifically, the controller 36 may determine the difference between the distance from the original work surface 106 to the lower surface 141 of each of the slots 110. At decision stage 63, the controller 36 may determine whether the difference in depth of the slots 110 exceeds the difference in depths threshold. If the difference in depth of the slots 110 exceeds the difference in depth threshold, the controller 36 may generate an alert command at stage 61.

If the difference in depth of the slots 110 does not exceed the difference in depth threshold, the controller 36 may determine at stage 64 the difference in slot start locations. In other words, the controller 36 may determine the offset between the start locations of the pair of slots 140. At decision stage 65, the controller 36 may determine whether the difference in slot start locations exceeds the berm start offset threshold. If the difference in slot start locations exceeds the berm start offset threshold, the controller 36 may generate an alert command at stage 61.

If the difference in slot start locations does not exceed the berm start offset threshold, the controller 36 may determine at stage 66, the difference in slot end locations. In other words, the controller 36 may determine the offset between the end locations of the pair of slots 140. At decision stage 67, the controller 36 may determine whether the difference in slot end locations exceeds the berm end offset threshold. If the difference in slot end locations exceeds the berm end offset threshold, the controller 36 may generate an alert command at stage 61.

If the difference in slot end locations does not exceed the berm end offset threshold, the controller 36 may determine at stage 68 the angle between the first slot 145 and the second slot 150. In doing so, the controller 36 may determine the relative orientations of the first centerline 149 of the first slot 145 and the second centerline 154 of the second slot 150. At decision stage 69, the controller 36 may determine whether the angle between the first slot 145 and the second slot 150 exceeds the angular orientation difference threshold. If the angle between the slots 110 exceeds the angular orientation difference threshold, the controller may generate an alert command at stage 61.

If the angle between the slots 110 does not exceed the angular orientation difference threshold at decision stage 69, the controller 36 may continue with the berm clearing command and generate appropriate commands at stage 70 to cut the berm 155 at desired locations to reduce or clear the berm.

It should be noted that when an alert command is generated at stage 61, the alert command may identify the specific threshold that has not been met. By including this information, an operator or other personnel may perform additional operations or take other action to modify the topography of the work site 100 to permit a berm clearing operation. In one example, if the berm 155 is too wide, a machine 10 may be directed to perform additional cutting operations in one or both of the slots 110 to reduce the size of the berm. In another example, if the difference in elevations of the lower surfaces 141 of the pair of slots 140 is too great, a machine 10 may be directed to change the respective elevation of one of the slots 110 to reduce the elevation difference. In still another example, if the pair of slots 140 is not sufficiently parallel, which results in a berm 155 with a tapering width, a machine 10 may be directed to perform additional cutting operations to the berm to adjust the direction of the slots or the width of the berm. If the berm start or end locations have too much offset, a machine 10 may be directed to modify one of the start or end locations of the slots to reduce the offset.

INDUSTRIAL APPLICABILITY

The industrial applicability of the control system 35 described herein will be readily appreciated from the forgoing discussion. The foregoing discussion is applicable to systems in which one or more machines 10 are operated autonomously, semi-autonomously, or manually at a work site 100. Such system may be used at a mining site, a landfill, a quarry, a construction site, a roadwork site, a forest, a farm, or any other area in which movement of material is desired.

As slots 110 are cut in work surface 104 of work site 100, berms 155 may be formed between pairs of slots 140. Berm reduction operations to reduce or clear the berms 155 may be periodically performed. Commands to perform a berm reduction may be generated by a planning system 45 based upon a plurality of factors including, for example, the depth of the pair of slots 140 and the width 161 of the berm 155 between the slots. In other situations, berm reduction commands may be generated manually by an operator or other personnel.

Once a berm clearing command has been generated, planning system 45 may be operative to analysis the physical characteristics of the pair of slots 140 and/or the berm 155 and compare the physical characteristics to one or more characteristic thresholds. If the physical characteristics are less than or within the applicable thresholds, the controller 36 may generate appropriate commands to begin the berm reduction operation. If the physical characteristics are greater than or outside of the applicable thresholds, the controller 36 may prevent the berm reduction operation and generate an alert command. If desired, the alert command may identify the specific threshold that has not been met.

It will be appreciated that the foregoing description provides examples of the disclosed system and technique. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for automated control of a machine having a ground-engaging work implement, comprising:

a position sensor for generating position signals indicative of a position of a work surface at a work site;

a controller configured to:

store a characteristic threshold of a pair of slots;

receive a plurality of position signals from the position sensor;

determine the position of the work surface along a first slot in the work site based upon the plurality of position signals to define a first slot surface;

determine the position of the work surface along a second slot in the work site based upon the plurality of position signals to define a second slot surface, the second slot being spaced from the first slot, the work surface along the first slot and the work surface along the second slot defining at least a portion of a berm between the first slot and the second slot;

determine a physical characteristic of the first slot and the second slot; and generate a berm reduction command if the physical characteristic of the first slot and the second slot is less than the characteristic threshold of the pair of slots.

2. The system of claim 1, wherein the first slot has a first slot lower surface and the second slot has a second slot lower surface, the characteristic threshold of the pair of slots is a difference in depth threshold between the first slot lower surface and the second slot lower surface and the controller is further configured to determine a difference in depth between the first slot lower surface and the second slot lower surface.

3. The system of claim 2, wherein the difference in depth threshold is approximately 20 degrees.

4. The system of claim 2, wherein the difference in depth threshold is equal to a rollover threshold of the machine.

5. The system of claim 1, wherein the characteristic threshold of the pair of slots is a berm width threshold and the controller is further configured to determine a width of the berm, and the controller will not generate the berm reduction command if the width of the berm is greater than the berm width threshold.

6. The system of claim 5, wherein the first slot has a first centerline and the second slot has a second centerline, and the controller is configured to determine the width of the berm based upon a distance between the first centerline and the second centerline.

7. The system of claim 5, wherein the first slot includes a first slot sidewall positioned closest to the second slot and the second slot includes a second slot sidewall positioned closest to the first slot, and the controller is configured to determine the width of the berm based upon a distance between the first slot sidewall and the second slot sidewall.

8. The system of claim 5, wherein the ground-engaging work implement has a width and the berm width threshold is approximately ⅓ of the width of the ground-engaging work implement.

9. The system of claim 1, wherein the characteristic threshold of the pair of slots is a difference in angular orientation threshold between the first slot surface and the second slot surface and the controller is further configured to determine a difference in angular orientation between the first slot and the second slot.

10. The system of claim 9, wherein the difference in angular orientation threshold is dependent upon a length of the berm between the first slot and the second slot.

11. The system of claim 1, wherein the characteristic threshold of the pair of slots is a berm start offset threshold, and the controller is further configured to determine a first start location of the first slot and determine a second start location of the second slot, and the controller will not generate the berm reduction command if a longitudinal distance between the first start location and the second start location is greater than the berm start offset threshold.

12. The system of claim 11, wherein the berm start offset threshold is a function of a rollover threshold of the machine.

13. The system of claim 1, wherein the characteristic threshold of the pair of slots is a berm end offset threshold, and the controller is further configured to determine a first end location of the first slot and determine a second end location of the second slot, and the controller will not generate the berm reduction command if a longitudinal distance between the first end location and the second end location is greater than the berm end offset threshold.

14. A controller-implemented method for automated control of a machine having a ground-engaging work implement, comprising:

storing a characteristic threshold of a pair of slots;

receiving a plurality of position signals from a position sensor;

determining a position of a work surface along a first slot in a work site based upon the plurality of position signals to define a first slot surface;

determining the position of the work surface along a second slot in the work site based upon the plurality of position signals to define a second slot surface, the second slot being spaced from the first slot, the work surface along the first slot and the work surface along the second slot defining at least a portion of a berm between the first slot and the second slot;

determining a physical characteristic of the first slot and the second slot; and generating a berm reduction command if the physical characteristic of the first slot and the second slot is less than the characteristic threshold of the pair of slots.

15. The method of claim 14, wherein the first slot has a first slot lower surface and the second slot has a second slot lower surface, the characteristic threshold of the pair of slots is a difference in depth threshold between the first slot lower surface and the second slot lower surface and further including determining a difference in depth between the first slot lower surface and the second slot lower surface.

16. The method of claim 14, wherein the characteristic threshold of the pair of slots is a difference in angular orientation threshold between the first slot surface and the second slot surface and further including determining a difference in angular orientation between the first slot and the second slot.

17. The method of claim 14, wherein the characteristic threshold of the pair of slots is a berm width threshold and further including determining a width of the berm, and not generating the berm reduction command if the width of the berm is greater than the berm width threshold.

18. The method of claim 14, wherein the characteristic threshold of the pair of slots is a berm start offset threshold, and further including determining a first start location of the first slot and determining a second start location of the second slot, and further including not generating the berm reduction command if a longitudinal distance between the first start location and the second start location is greater than the berm start offset threshold.

19. The method of claim 14, wherein the characteristic threshold of the pair of slots is a berm end offset threshold, and further including determining a first end location of the first slot and determining a second end location of the second slot, and not generating the berm reduction command if a longitudinal distance between the first end location and the second end location is greater than the berm end offset threshold.

20. A machine, comprising:

a prime mover;

a ground-engaging work implement for engaging a work surface along a path;

a position sensor for generating position signals indicative of a position of a work surface at a work site;

a controller configured to:

store a characteristic threshold of a pair of slots;

receive a plurality of position signals from the position sensor;

determine the position of the work surface along a first slot in the work site based upon the plurality of position signals to define a first slot surface;

determine the position of the work surface along a second slot in the work site based upon the plurality of position signals to define a second slot surface, the second slot being spaced from the first slot, the work surface along the first slot and the work surface along the second slot defining at least a portion of a berm between the first slot and the second slot;

determine a physical characteristic of the first slot and the second slot; and generate a berm reduction command if the physical characteristic of the first slot and the second slot is less than the characteristic threshold of the pair of slots.

* * * * *